United States Patent [19]

Meyer et al.

[11] 4,157,183

[45] Jun. 5, 1979

[54] GAME APPARATUS

[75] Inventors: Burton C. Meyer, Downers Grove; Alan A. Hicks, Chicago, both of Ill.

[73] Assignee: Marvin Glass & Associates, Chicago, Ill.

[21] Appl. No.: 816,379

[22] Filed: Jul. 18, 1977

[51] Int. Cl.[2] ..... A63F 3/00

[52] U.S. Cl. ..... 273/243; 273/1 R; 273/287; 46/146; 273/288; 46/118

[58] Field of Search ..... 273/1 R, 1 M, 140, 236, 273/280

[56] References Cited

U.S. PATENT DOCUMENTS

| | | | |
|---|---|---|---|
| 1,594,164 | 7/1926 | Foster | 273/140 X |
| 2,848,232 | 8/1958 | Waddell | 273/140 X |
| 2,933,315 | 4/1960 | Carr, Jr. | 273/140 X |
| 3,053,538 | 9/1962 | Roca | 273/139 |
| 3,545,750 | 12/1970 | Stachnik | 273/140 X |
| 3,628,792 | 12/1971 | Frederick et al. | 273/140 X |

FOREIGN PATENT DOCUMENTS

| | | | |
|---|---|---|---|
| 1090142 | 9/1960 | Fed. Rep. of Germany | 273/1 R |

*Primary Examiner*—Richard C. Pinkham
*Assistant Examiner*—R. Carl Moy
*Attorney, Agent, or Firm*—Mason, Kolehmainen, Rathburn & Wyss

[57] ABSTRACT

A game apparatus based on a sea monster theme includes a rotatably mounted platform defining a plurality of positions for the placement of playing pieces by the players of the game. A retrieving mechanism is randomly actuated by rotation of the platform causing a movable element, simulating a sea monster, to retrieve one of the playing pieces from an indexed position on the rotatable platform. The movable element is pivotally mounted and biased for movement toward the playing piece upon release by a trip mechanism mounted below the platform. A governor regulates movement of the movable element and a biased catch mechanism on the end of the element grasps the playing pieces from the playing surface.

17 Claims, 11 Drawing Figures

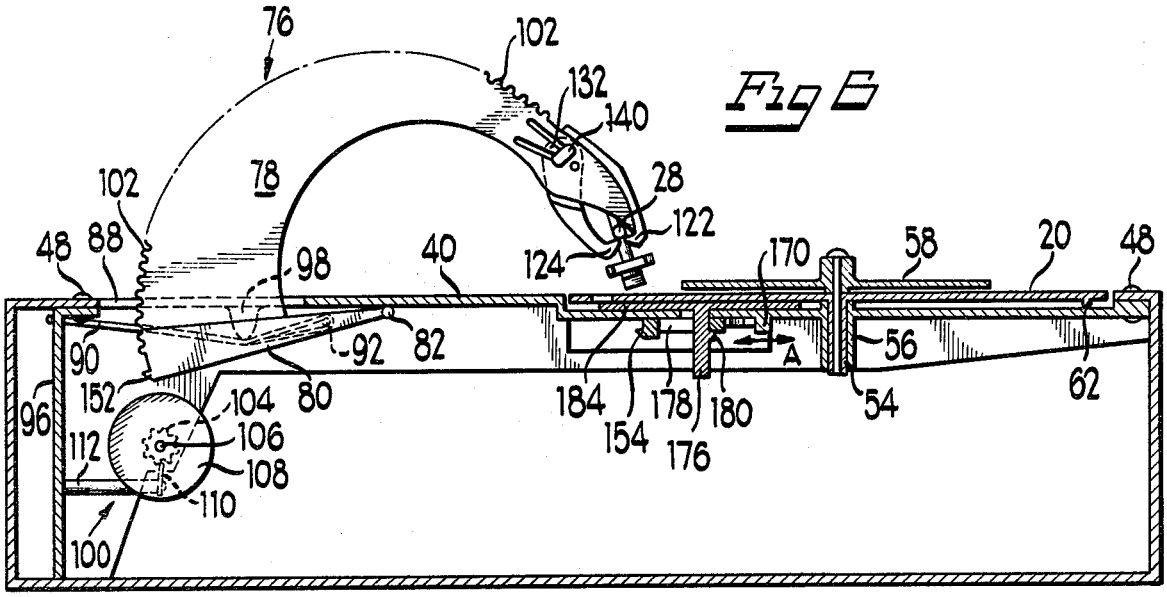
Fig 6
Fig 7
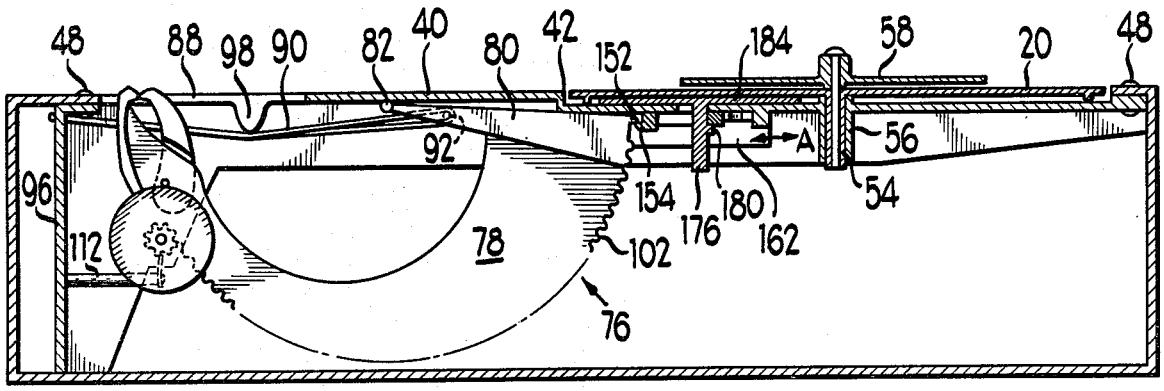
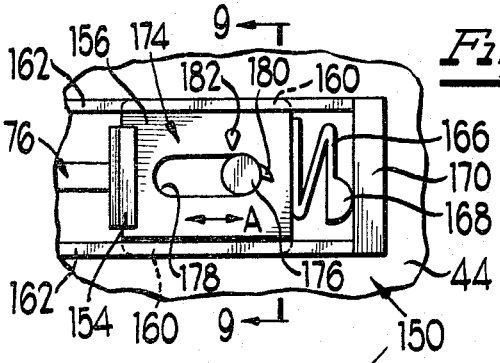
Fig 8
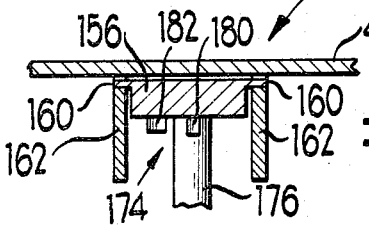
Fig 9
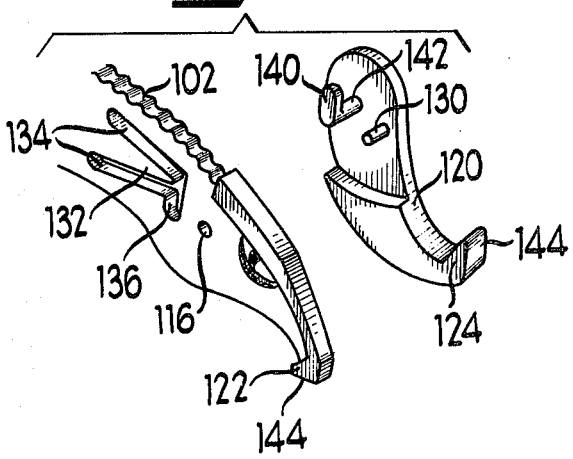
Fig 10

GAME APPARATUS

BACKGROUND OF THE INVENTION

1. Field of the Invention

The present invention relates to games of chance and skill and in particular to a game apparatus based upon a sea monster theme.

2. Brief Description of the Prior Art

Many games have been produced based upon various themes, such as space themes, detective sets, western or camping-type sets, and the like. Many of these games are controlled purely by a chance device while some others have relied purely on the skill of the players. The present invention is directed to a new and improved game apparatus based on a sea monster theme in which both elements of chance and skill are involved in determining the outcome and the winner of the game.

SUMMARY OF THE INVENTION

An object of the present invention is to provide a new and improved game apparatus.

In accordance with the above and other objects, the present invention is a game apparatus based on a sea monster theme including a rotatably mounted platform defining a plurality of positions for the placement of playing pieces by the players of the game. A retrieving mechanism is randomly actuated by rotation of the platform causing a movable element, simulating a sea monster, to retrieve one of the playing pieces from an indexed position on the rotatable platform. The movable element is pivotally mounted and biased for movement toward the playing piece upon release by a trip mechanism mounted below the platform. A governor regulates movement of the movable element and a biased catch mechanism on the end of the element grasps the playing pieces from the playing surface.

Other objects, features and advantages of the invention will be apparent from the following detailed description taken in connection with the accompanying drawings.

BRIEF DESCRIPTION OF THE DRAWINGS

FIG. 6 is a vertical cross-sectional view of the game apparatus taken generally along line 6—6 of FIG. 1;

FIG. 7 is another vertical cross-sectional view similar to FIG. 6 showing a movable arm in its cocked position;

FIG. 8 is a partially fragmented, bottom plan view of a release trip mechanism of the game apparatus;

FIG. 9 is a vertical cross-sectional view of the trip mechanism taken generally along line 9—9 of FIG. 8;

FIG. 10 is an exploded, perspective view of a grasping device on the end of the movable arm.

DESCRIPTION OF THE PREFERRED EMBODIMENT

Figure 1:
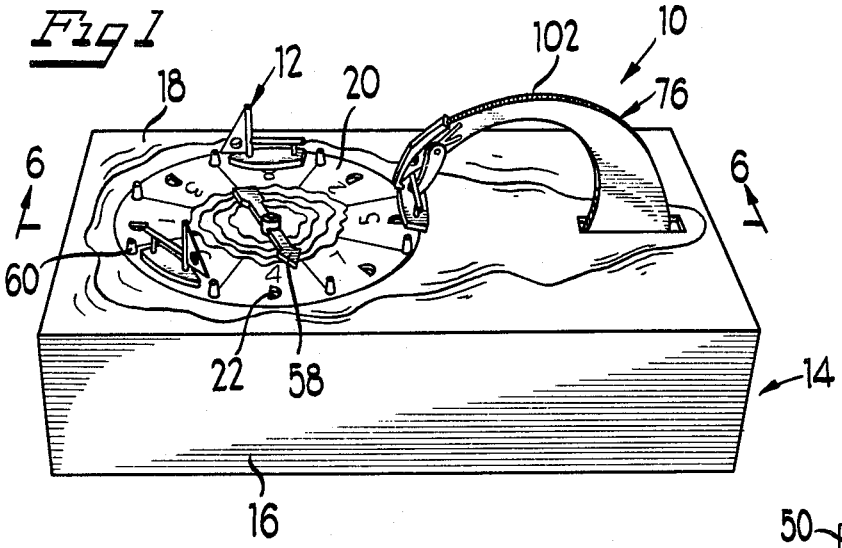
FIG. 1 is a perspective view of a game apparatus made in accordance with the concepts of the present invention.
Figure 5:
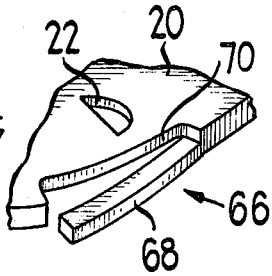
FIG. 5 is a partially fragmented, perspective view, on an enlarged scale, of one of the reverse stop tabs on the platform.

A game apparatus embodying the concepts of the present invention is shown in FIG. 1, and generally designated 10. A plurality of playing pieces 12 (FIG. 11) are provided for use in the game which is based on a sea monster theme. The game apparatus includes a generally rectangular, raised housing 14 including a plurality of peripheral side walls 16 which support an upper surface 18 in view of two or more players of the game. A rotatable platform 20 includes a plurality of numbered stations, which in the case of the preferred embodiment, comprises eight stations. Each one of the stations includes a D-shaped aperture 22 (FIGS. 3 and 5) for removably mounting one of the playing pieces 12.

Figure 11:
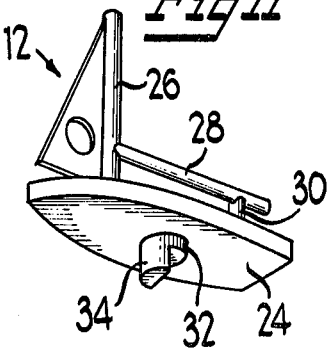
FIG. 11 is a perspective view of the underside of one of the playing pieces used in the game.

Referring to FIG. 11, each of the playing pieces 12 is in the shape of a miniature sailboat including a hull 24, a mast and sail 26, and a horizontal arm 28 secured between the mast 26 and a rear post 30. A depending post 32 is provided on the bottom of the hull and includes an extended D-shaped portion 34 which fits within one of the apertures 22 to properly align the playing piece relative to the rotatable platform 20.

Figure 2:
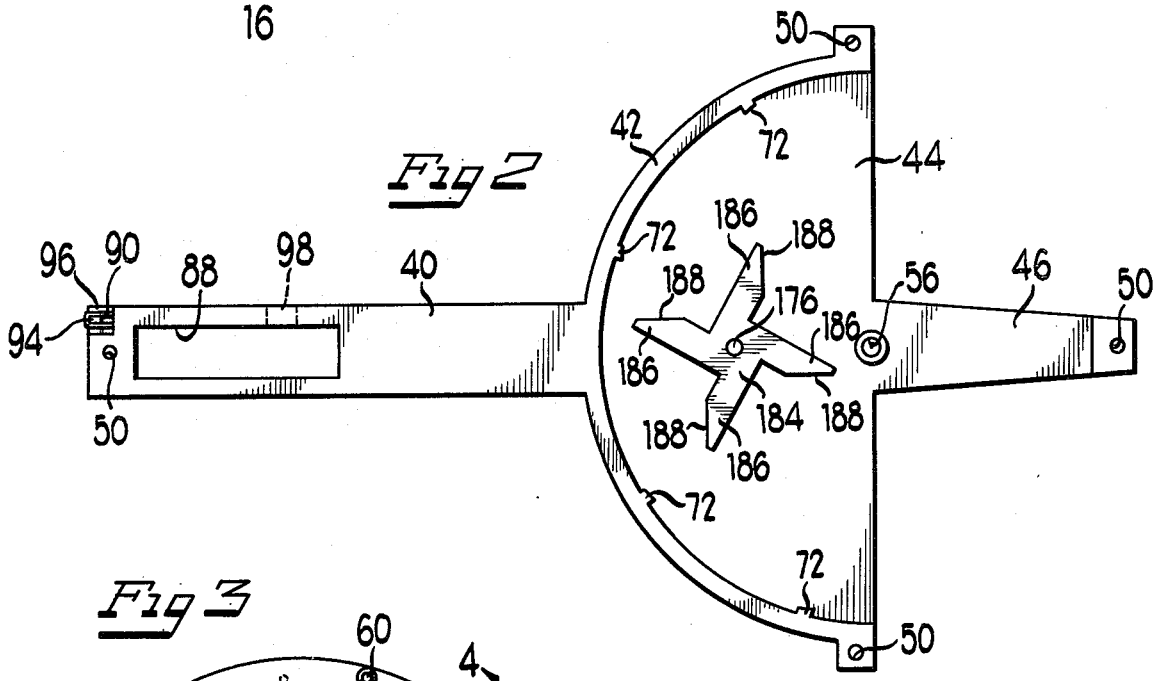
FIG. 2 is a top plan view, on an enlarged scale, of a mounting frame used in the game apparatus of FIG. 1.

The rotatable platform 20 is mounted by a subframe assembly, generally designated 36, in FIG. 2. The subframe assembly 36 includes a tongue portion 40 which, as shown in FIGS. 1, 6 and 7, is mounted in a flush relationship with the top 18 of the housing. The tongue 40 is connected or molded integrally with an arcuate flange portion 42 circumscribing a flat, semi-circular web 44. The web 44 includes a coplanar mounting tab 46 so that the entire subframe assembly 36 can be secured to the top surface 18 by means of rivets or other fasteners 48 through apertures 50 at the periphery of the tongue, flange and tab, respectively.

Figure 3:
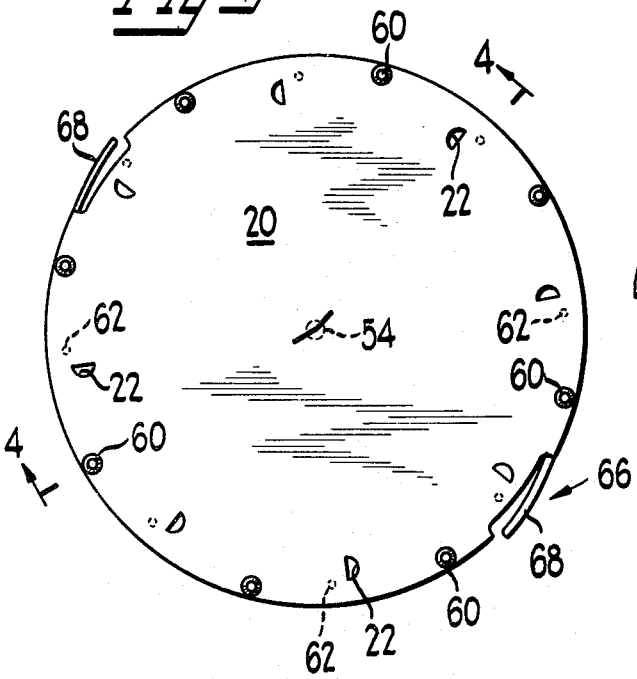
FIG. 3 is a top plan view of a rotatable platform shown in FIG. 1.
Figure 4:
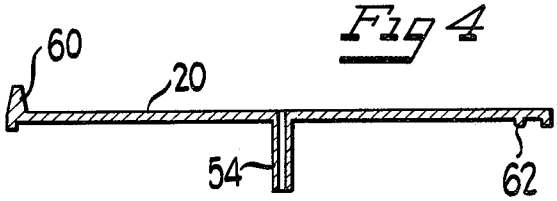
FIG. 4 is a vertical cross-sectional view taken generally along line 4—4 of FIG. 3 of the platform.

Referring to FIGS. 2–4, the rotatable platform 20 includes a central, hollow, mounting shaft 54 which rotatably mounts the platform 20 within an appropriate journal 56 formed generally in the center of the web 44. A spinner 58 is rotatably mounted in the hollow shaft to provide a chance device for the play of the game as described hereinafter.

The platform 20 includes a plurality of upstanding posts or studs 60 about the periphery thereof which facilitate manual rotation of the platform 20. A plurality of small bosses 62 are provided on the bottom of the rotatable disc 20, generally adjacent the apertures 22 for supporting the disc on the web 44 and tab 46 in a coplanar position with the top 18 and tongue 40.

A reverse lock means, generally designated 66, prevents rotation of the platform 20 in a clockwise direction. More specifically, referring to FIG. 5, the reverse lockout mechanism includes a pair of integrally molded flexible elements 68 formed at at least two peripheral positions on the platform 20 adjacent a pair of cutouts 70. The flexible members 68 are formed so as to extend generally outwardly from the circular periphery of the platform 20 during the forming or manufacture thereof. Referring to FIG. 2, the flange 42 includes a plurality of reverse stops 72 extending radially inwardly for engagement with the flexible elements 68 which permit rotation of the rotatable platform 20 in a clockwise direction, but prevents counterclockwise rotation.

According to the rules and theme of the game, a retrieval means in the form of a mythical sea monster, generally designated 76, is randomly released to attack and capture one of the playing pieces as shown in FIGS.

1 and 6. The retrieval means or sea monster 76 includes a generally elongated arcuate member 78 which is formed generally in the shape of the neck and head of a mythical sea monster and is pivotally mounted by a triangular base flange 80 and pin 82 to the bottom of the tongue 40. The pin 82 is secured to the base flange 80 by any suitable means to permit pivotal movement of the arcuate neck member 78.

A generally rectangular aperture 88 is provided in the lefthand end of the tongue 40 as shown in FIGS. 2, 6 and 7 to permit movement of the sea monster through the aperture from a retracted position as shown in FIG. 7 to an extended or attacking position as shown in FIG. 6. Biasing means in the form of a rubberband 90 is secured, on one end to a post 92 on the triangular flange 80 to a notched portion or catch 94 provided on an interior vertical wall 96. The rubberband 90 is stretched across a boss 98 to prevent an overcenter locking condition from occurring and therefore the biasing means constantly urges the sea monster 76 toward the extended or attacking position of FIG. 6.

Governor means, generally designated 100, is provided to control and smooth the motion of the sea monster 76 as it is moved under the force of the biasing means 90. The governor means 100 includes an arcuate series of gear teeth 102 on the outwardly directed edge of the sea monster 76 which engage a generally small pinion gear 104 during substantially the entire length of travel of the sea monster. The gear teeth 102 also serve to simulate fins or various types of armor frequently associated with prehistoric animals. The pinion gear 104 is conjointly mounted by a shaft 106 within the housing to a weighted fly-wheel 108 which serves to regulate the movement of the sea monster 76. Sound generating means in the form of a vibratory leaf 110 is mounted by a generally horizontal shaft 112 secured to the wall 96 with the free outer end of the leaf positioned in the path of travel of the pinion gear 104, so that, as the pinion gear rotates the leaf is vibrated. As the sea monster moves toward the extended position under the force of the biasing means 90, or when it is manually returned to its retracted position, the leaf is vibrated producing an audible signal.

Referring to FIG. 10, the sea monster 76 includes grasping device, generally designated 114, for grasping the playing objects 12 about the horizontal member 28 for capture, as shown in FIG. 6. The grasping device includes a simulated face or head of the monster including an aperture or eye 116, an upper jaw portion 118 and a lower jaw portion 120. Both the upper jaw portion 118 and the lower jaw portion 120 include a hook element 122 and 124, respectively, on the outer end thereof which serves to grasp the horizontal element 28 of the playing pieces 12. The lower jaw 120 is pivotally mounted by a post 130 rotatably mounted within the eye aperture 116. Biasing means in the form of an integrally molded, generally triangular spring element 132 is formed by a pair of converging grooves or cutouts 134 which intersect and terminate in a generally transversely directed end slot 136. An upwardly directed lobe 140 is secured to the lower jaw member 120 by a small stud 142 so that the lobe 140 will maintain and secure the lower jaw member 120 to the upper jaw member 118 while permitting the spring element 132 to bias the stud 142 downwardly, thus constantly urging the jaw portions toward one another. The hook elements 122 and 124 on the ends of the respective jaw portions, each include a canted cam surface 144 which engages the horizontal shaft 28 on the playing pieces 12 to open the jaw portions against the biasing force of the spring element 132 and thus permit the capture and pickup of an appropriately positioned playing piece 12 as the sea monster 76 is activated to lunge forward to its extended position, under the force of the biasing means 90.

A trip means, generally designated 150 (FIGS. 8 and 9), is provided for randomly actuating the retrieval means or sea monster 76 as described hereinafter. The neck portion of the sea monster includes a notch formed by a saw-tooth 152 at the extreme end of the triangular base flange 80. When the sea monster is in the retracted position, as shown in FIG. 7, the saw-tooth 152 is captured by an L-shaped latch 154 secured to a slide plate 156. Referring to FIGS. 8 and 9, the slide plate 156 includes a pair of generally horizontal ears 160 of reduced cross-section which support the slide plate for reciprocal sliding movement in the direction of arrows "A" in appropriate slots formed between a pair of vertical webs 162 on the underside of the portion 44 of the subassembly 36. The webs 162 also serve to properly align the slide plate 156 for reciprocal movement.

Another biasing means in the form of an integrally molded leaf spring 166 is provided on the righthand end of the slide plate 156, as shown in FIG. 8, having a free end 168 in engagement with a spring pad 170. The slide plate 156 is thereby biased to the left, as shown in FIG. 9, and into engagement with the saw-tooth 152 of the sea monster.

The trip mechanism 150 is actuated by movement toward the right to thereby release the sea monster 76 as the tooth 152 is disengaged from the latch 154. The release is accomplished by a cam mechanism, generally designated 174 including a vertically extending, rotatably mounted shaft 176 which projects through an oval aperture 178 in the slide plate 156. The shaft 176 includes a cam 180 secured thereto, at a level adjacent the slide plate 156 so that, the cam will engage a cam follower 182 on the slide plate 156 as the shaft 176 is rotated. Thus, for every revolution of the shaft 176, the slide plate 156 will be moved, generally toward the right, to actuate the trip release mechanism.

The shaft 176 extends upwardly through its journal aperture in the semi-circular web portion 44 and is connected to a starwheel 184 mounted in a contacting relationship on the top of the web 44. The starwheel 184 includes four radially directed arms 186 which extend outwardly, a sufficient distance, so as to lie beneath the path of the D-shaped apertures 22 in the rotatable platform 20. The starwheel 184 is thin enough to be sandwiched between the platform and the upper surface of the portion 44 and each arm thereof includes a canted cam surface 188 which is engageable with the downwardly extending D-shaped portion 34 of the playing pieces which are mounted within the apertures 22. Thus, as the platform 20 is rotated, those stations which have a playing piece mounted thereon will cause the starwheel 184 to rotate through an arc of approximately 90°, so that each time a succession of four playing pieces 12 move past a center line position aligned with the tongue 40, the trip mechanism 150 is actuated causing the retrieval mechanism or sea monster 76, to be released for attack and capture of every fourth playing piece passing the tongue.

In a typical scheme of play of the game, each of two to eight players begins with a predetermined number of playing pieces 12, such as five, for example. Each set of playing pieces, belonging to a particular player, are color coded for that particular player. Since the number of stations on the rotatable platform or disc 20 is eight, the maximum number of players which can participate at one time, using the structure of the preferred embodiment, is eight. Each player places one of his color coded playing pieces 12 on the rotatable disc at one of the stations aligning the downward, D-shaped protrusion 34 within one of the apertures 22. The players randomly select one player to start the game and then continue in order from that particular player. For example, the spinner 58 can be utilized with the numbers on the stations to determine which player will start the game.

The first player begins the game by manually rotating the spinner 58. If the station at which the spinner stops is occupied by a playing piece 12, the first player has a choice of moving that playing piece to any empty space on the disc, be it his own playing piece or that of another player in the game. The object in moving the playing pieces is to bring an opponent's playing piece in closer danger of being attacked by the sea monster 76 or, to move the player's own playing piece away from such danger. If the spinner lands on an empty station, the player may be required to place one of his playing pieces on that particular station on the rotating platform. If a player has no more playing pieces to use, he may move another playing piece already on the platform to the indicated station.

After the player has made the appropriate move, by moving his own playing piece or that of another, he may turn the disc counterclockwise by the number of stations as determined by the particular number on the station indicated by the spinner. If, during this rotation of the rotatable platform, the sea monster 76 attacks and captures a playing piece, that playing piece is out of the game and the particular player's turn terminates. The play of the game continues and the player with the last remaining playing piece on the disc 20 is the winner of the game.

The foregoing detailed description has been given for clearness of understanding only and no unnecessary limitations should be understood therefrom as some modifications will be obvious to those skilled in the art.

We claim:

1. A game apparatus, comprising:

a base;

a platform movably mounted on the base;

at least one playing piece adapted to be removably mounted on the platform;

means for retrieving a playing piece from the platform; and trip means for actuating said retrieval means to retrieve a playing piece from said platform, said trip means being automatically actuated in response to a predetermined movement of said platform.

2. The game apparatus of claim 1 wherein said retrieval means comprises an arm member and means for biasing said arm toward engagement with a playing piece in a particular position on said base when actuated by said trip means.

3. The game apparatus of claim 2 wherein said arm member is pivotally mounted on said base for movement toward said playing piece under the influence of said biasing means.

4. A game apparatus, comprising:

a base;

at least one playing object adapted to be movably mounted on the base;

means for retrieving a playing piece from the base comprising an arm member and means for biasing said arm toward engagement with a playing piece in a particular position on said base, said arm member including a rack portion in engagement with governor means for regulating the speed of movement of said arm toward said playing piece; and trip means for actuating said retrieval means to retrieve a playing piece from said base.

5. The game apparatus of claim 4 wherein said arm member includes grasping means on one end for retrieving a playing piece from the base.

6. The game apparatus of claim 1 wherein said trip means includes latch means supported from said base, said latch means normally biased into engagement with said retrieving means to retain the same from moving toward said playing piece.

7. The game apparatus of claim 1 wherein said platform includes a plurality of positions defined thereon, each position including means for receiving one of said playing pieces.

8. A game apparatus, comprising:

a base;

at least one playing piece;

a platform rotatably mounted on said base, said platform including a plurality of positions defined thereon, each position including means for receiving a playing piece;

means for retrieving a playing piece from said platform;

trip means for actuating said retrieval means to retrieve a playing piece from said platform; and each said playing piece including means thereon for operably engaging said trip means to provide actuation of said retrieval means.

9. The game apparatus of claim 8 wherein said trip means includes a star wheel rotatably mounted on said base and said means on said playing pieces includes an extended portion for engaging said star wheel to rotate the same in response to rotation of said rotary platform.

10. A game apparatus, comprising:

a base;

a platform rotatably mounted on said base, said platform including a plurality of stations thereon;

at least one playing object adapted to be removably mounted on said rotatable platform at said station;

retrieval means for capturing a playing piece when one of said stations on said platform is rotated to a predetermined position; and trip means associated with said retrieval means for actuation thereof to capture a playing piece located in said predetermined position on said platform, said trip means being automatically actuated in response to rotation of the platform to a predetermined position.

11. The game apparatus of claim 10 wherein said playing piece includes means thereon for engaging said trip means to provide actuation of said retrieval means.

12. The game apparatus of claim 10 including a plurality of said playing pieces.

13. The game apparatus of claim 12 wherein said plurality of playing pieces include a plurality of subsets of color coded playing pieces.

14. A game apparatus, comprising:

a base;

a platform rotatably mounted on said base, said platform including a plurality of stations thereon;

a plurality of playing pieces, including a plurality of subsets of distinguishable playing pieces, adapted to be removably mounted on said rotatable platform at said stations;

retrieval means for capturing a playing piece when one of said stations on said platform is rotated to a predetermined position; and trip means associated with said retrieval means for actuation thereof to capture a playing piece located in said predetermined position on the platform, said trip means including a rotatably mounted element operable for actuating said retrieval means in response to a preselected amount of rotation of said element.

15. The game apparatus of claim 14 wherein each of said playing pieces includes a key portion for receiving the playing piece in a selected position on said rotatable platform and for engaging said rotatably mounted element upon rotation of said platform for operating said trip means in response to a selected amount of rotation of said platform.

16. The game apparatus of claim 15 wherein said retrieval means comprises an extended member pivotally mounted on the base for movement from a retracted position, toward one of said playing pieces, to an extended position for capturing a playing piece on said platform.

17. The game apparatus of claim 16 including biasing means associated with said extended member for biasing said member toward said extended position.

* * * * *